US006757918B2

(12) United States Patent
Högger

(10) Patent No.: US 6,757,918 B2
(45) Date of Patent: Jul. 6, 2004

(54) WASTE OUTLET FITTING FOR A SANITARY APPLIANCE, IN PARTICULAR A URINAL

(75) Inventor: Roland Högger, Rapperswil (CH)

(73) Assignee: Geberit Technik AG (CH)

( * ) Notice: Subject to any disclaimer, the term of this patent is extended or adjusted under 35 U.S.C. 154(b) by 0 days.

(21) Appl. No.: 10/361,461

(22) Filed: Feb. 10, 2003

(65) Prior Publication Data

US 2003/0150051 A1 Aug. 14, 2003

(30) Foreign Application Priority Data

Feb. 11, 2002 (EP) ..... 02405100

(51) Int. Cl.[7] ..... E08D 13/00

(52) U.S. Cl. ..... 4/310; 4/679; 4/681; 4/695; 4/301; 4/424

(58) Field of Search ..... 4/679, 681, 695, 4/301, 424, 428, 310; 137/247.41, 247.49, 247.51

(56) References Cited

U.S. PATENT DOCUMENTS 766,764 A * 8/1904 Keyt ..... 137/247.49
4,403,355 A * 9/1983 Petty ..... 4/679
5,257,422 A * 11/1993 Ruegg ..... 4/307
6,269,495 B1 * 8/2001 Sondrup ..... 4/679
6,401,266 B1 * 6/2002 Mitchell et al. ..... 4/309
6,701,541 B2 * 3/2004 Romagna et al. ..... 4/301
2002/0000246 A1 * 1/2002 Rost ..... 137/247.41

* cited by examiner

*Primary Examiner*—Henry Bennett
*Assistant Examiner*—Azadeh Kokabi
(74) *Attorney, Agent, or Firm*—Webb Ziesenheim Logsdon Orkin & Hanson, P.C.

(57) ABSTRACT

A waste outlet fitting having a siphon which is mounted in a cup-shaped housing. The siphon has an inlet and an outlet and is inserted into the housing from above. For cleaning and maintenance, the siphon can be removed upwardly and subsequently re-inserted from above. Arranged at the inlet of the siphon is an inflow funnel which can likewise be installed and removed from above. The waste outlet fitting makes especially simple cleaning and maintenance of the waste outlet fitting and of the soil pipe possible.

20 Claims, 3 Drawing Sheets

WASTE OUTLET FITTING FOR A SANITARY APPLIANCE, IN PARTICULAR A URINAL

BACKGROUND OF THE INVENTION

1. Field of the Invention

The invention relates to a waste outlet fitting for a sanitary appliance, in particular lavatory or urinal, with a siphon which forms a stench trap and has an inlet, which is to be connected to a waste outlet opening of a sanitary body, and an outlet, which is to be connected to a soil pipe.

2. Description of the Prior Art

Waste outlet fittings of the said type are generally known in sanitary engineering, for example in flush bowls and urinals. In the case of a urinal, for example, flushing water passes through the waste outlet opening into the siphon and finally into the soil pipe. Sealing water is present in the siphon up to an overflow and forms a stench trap which is intended to prevent gases escaping from the soil pipe into the sanitary body. Especially in the case of heavily frequented urinals and no-mix lavatories, the necessary regular cleaning and maintenance of the waste outlet fitting is comparatively complicated. Blockages of the siphon and of the soil pipe, which occur relatively frequently, lead to failures and to complicated removal of the siphon.

SUMMARY OF THE INVENTION

The object of the invention is to produce a waste outlet fitting of the said type which is suitable in particular for urinal installations and in which cleaning and maintenance are simplified. The waste outlet fitting is nevertheless intended to be functionally reliable.

The object is achieved in a waste outlet fitting of the generic type by virtue of the fact that the siphon can be inserted into the waste outlet opening of the sanitary body from above and can be removed upwardly from this opening. In the waste outlet fitting according to the invention, the siphon is not, as was previously usual, attached from below to a downward-projecting neck of the waste outlet opening but is inserted from above. For cleaning of the waste outlet fitting and of the soil pipe, the siphon is in a simple manner removed from above and can then be cleaned or replaced. In this connection, the sanitary body does not have to be removed from the wall. A siphon which is no longer serviceable can be replaced with a new siphon in a simple manner. Moreover, better accessibility to the soil pipe is thus guaranteed.

According to a development of the invention, the siphon is a suction siphon, which functions in the same way as a standard siphon.

According to a development of the invention, the siphon is mounted in a cup-shaped housing. This housing is located below the waste outlet opening and receives the siphon. For easier installation of the siphon into and removal of the siphon from the cup-shaped housing, the siphon is guided in this cup-shaped housing. Guiding the siphon in the cup-shaped housing simplifies in particular installation of the siphon and ensures that it is always installed in the correct position. The cup-shaped housing can moreover serve as a measuring cup for adjusting the flushing water quantity.

According to a development of the invention, an upwardly directed inflow funnel is arranged at the inlet of the siphon. This inflow funnel can be connected fixedly or detachably to the siphon. If this inflow funnel is connected detachably to the siphon, cleaning is simplified further still, and different materials can be used for manufacture. The siphon and the inflow funnel can then be removed and cleaned as individual parts. Preferably, the inlet of the inflow funnel is also covered by a hat-shaped cap.

According to a development of the invention, a waste outlet bend, which forms a sump and connects the siphon to the soil pipe, is connected to the lower end of the siphon. The suction effect of the waste outlet fitting can be increased considerably by means of such a waste outlet bend. This has the advantage that flushing can be performed using very little water, for example 1 litre. Consequently, water can thus be saved. In the case of public and very frequently used urinals, this leads to considerable savings. The waste outlet bend is preferably connected detachably to the siphon. When the siphon is removed, the waste outlet bend consequently remains connected to the soil pipe. When the siphon has been removed, the waste outlet bend and the soil pipe are comparatively easily accessible for cleaning.

According to a development of the invention, the outlet of the siphon is of stopper-shaped design and is inserted removably into a corresponding recess of the housing. The siphon can thus be installed and removed without tools. When the siphon is installed, the stopper-shaped outlet is inserted into the corresponding recess of the housing. Such a connection can also be made blind.

Further advantageous features emerge from the dependent patent claims, the description below and the drawing.

An illustrative embodiment of the invention is explained in greater detail below with reference to the drawing, in which

DETAILED DESCRIPTION OF THE PREFERRED EMBODIMENTS

Figure 1:
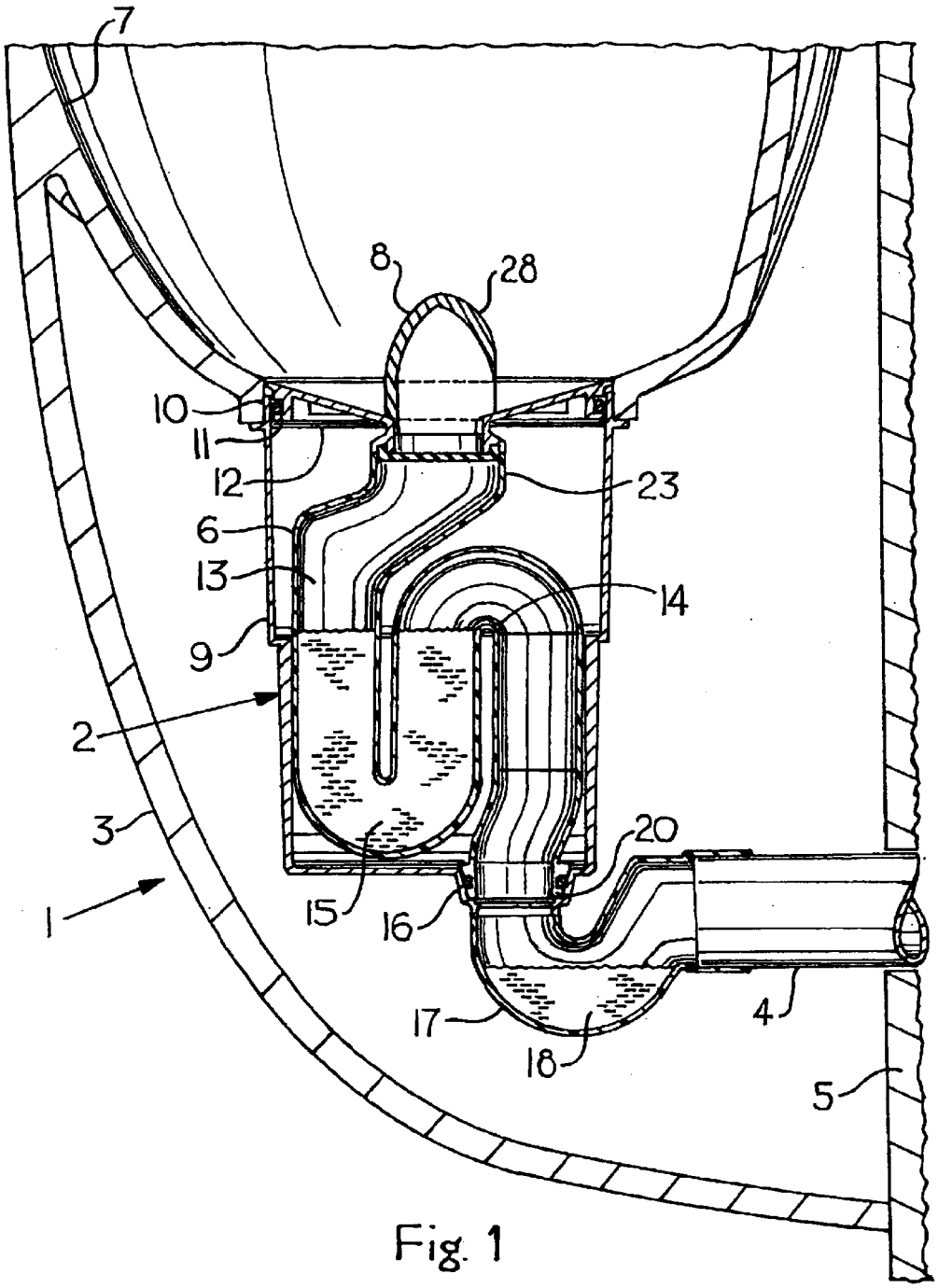
FIG. 1 is a vertical section through a sanitary appliance with a waste outlet fitting according to the invention.

FIG. 1 shows a urinal 1 which has a sanitary body 3, for example made of ceramic material, only the lower part of which is shown here. The bowl 7 has in its bottom an opening 10 which is preferably circular and into which a waste outlet fitting 2 is inserted. This fitting has a siphon 6 which is inserted into a cup-shaped housing 9 open at the top and has an inlet 23 at an upper end and an outlet 20 at a lower end. The siphon 6 is S-shaped as usual and has an overflow edge 14, in front of which sealing water 15 builds up.

Figure 2:
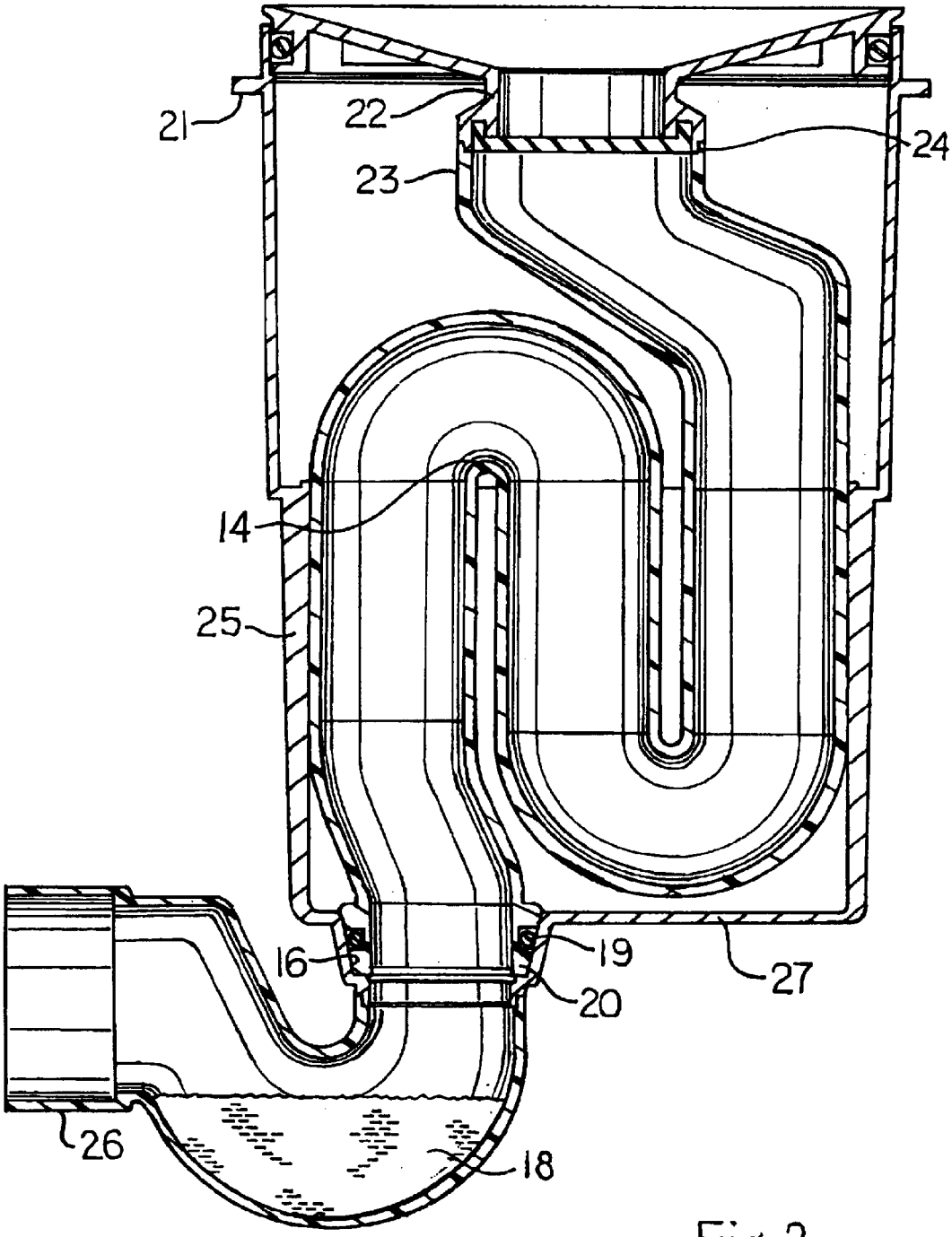
FIG. 2 is a vertical section through a waste outlet fitting according to the invention.
Figure 3:
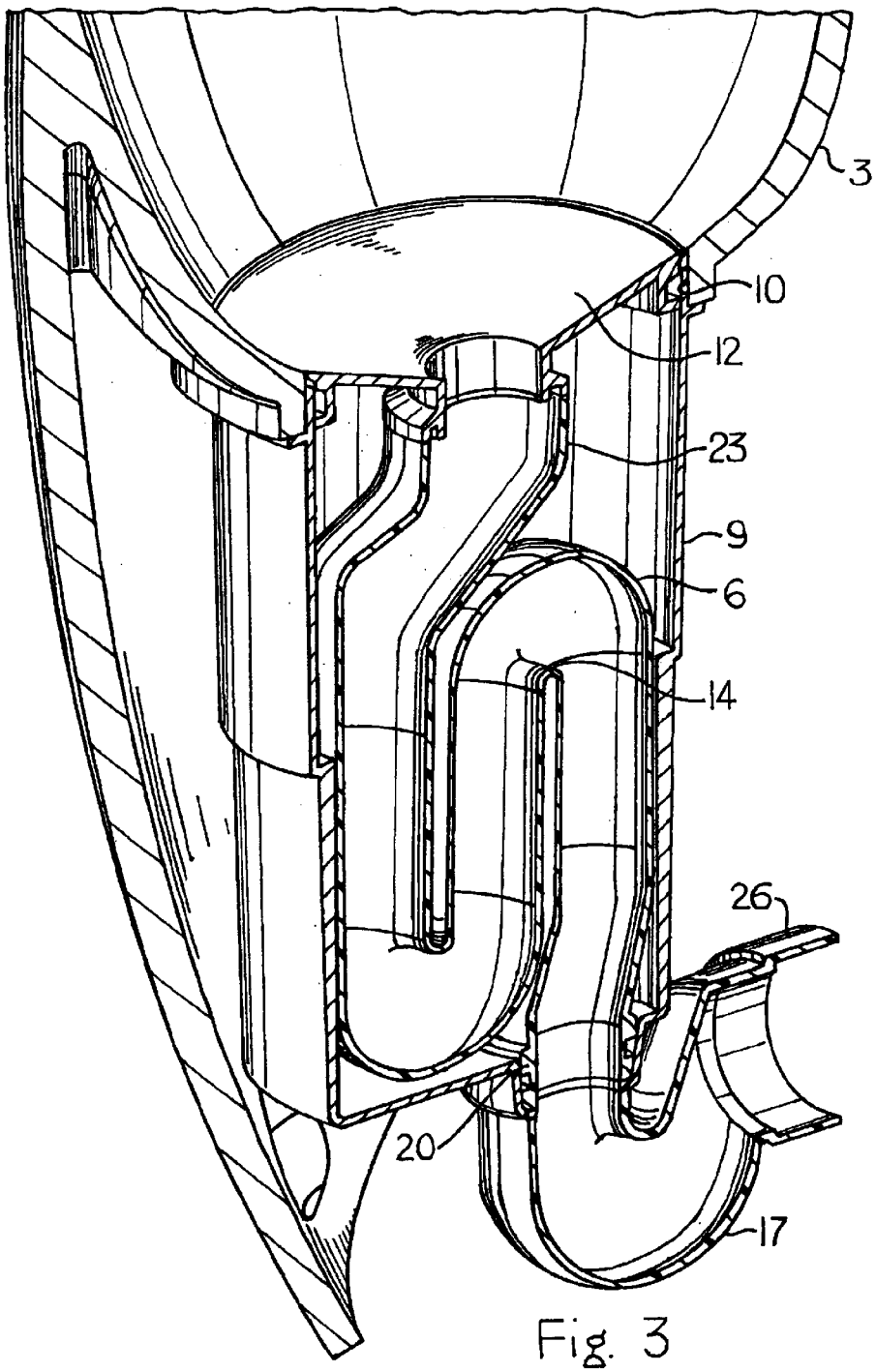
FIG. 3 is another, three-dimensional view of a sectioned sanitary appliance with a waste outlet fitting according to the invention.

The inlet 23 of the siphon 6 is, by means of a separable insertion connection 24 (FIG. 2), connected to a tubular neck 22 of an inflow funnel 12 which has an upper opening 8. However, the insertion connection 24 can also be replaced by a non-separable connection. The inflow funnel 12 can, for example, be welded together with the siphon 6. The inflow funnel 12 is inserted into the housing 9 from above and is sealed against it by a sealing ring 11. The inlet of the inflow funnel 12 can be covered by a cap 28 as a visual screen. The outlet 20 of the siphon 6 is of stopper-shaped design and is inserted removably into a corresponding recess 16 in the bottom 27 of the housing 9. A sealing ring 19 seals the outlet in relation to the housing 9. The outlet 20 of the siphon 6 is inserted into the recess 16 from above and can be locked therein. The recess 16 is open at the bottom and leads to a waste outlet bend 17 which is fastened to the housing 9 and has a neck 26 which extends horizontally and is connected to a soil pipe 4. The waste outlet bend 17 can be attached fixedly to, for example welded together with, the housing 9. When the sanitary body. 3 is mounted, the waste outlet bend 17 is connected blind. The waste outlet bend 17 is designed in such a way that it forms a sump 18 which narrows the air passage without the cross section being reduced in this connection. The sump 18 increases the suction effect of the siphon 6 in a manner known per se. The waste outlet fitting 2 can thus be used with very little water or even without water.

In a lower region of the cup 9, the siphon 6 is guided for installation and removal by means of vertically extending ribs 25. The siphon 6 can be lifted out of the housing together with the inflow funnel 12. If the inflow funnel 12 is connected detachably to the siphon 6, the inflow funnel 12 can also be lifted out upwardly separately. Subsequently, the siphon 6 can then be taken out of the housing 9. The waste outlet bend 17 and the soil pipe are then accessible from above and can, if necessary, be cleaned, or articles can be removed from the bend. After the siphon 6 and the inflow funnel 12 have been cleaned, they are reinserted into the housing 9 from above. As explained, the siphon 6 is in this connection guided on the guide ribs 25. Tools are not necessary for installation or removal. After installation, the bowl 7 is flushed, and in this way a stench trap is again formed in the siphon 6 by the sealing water 15. In this connection, the sump 18 is at the same time formed in the waste outlet bend 17 with water. The urinal 1 is then already ready for use again. The housing 9 can be manufactured cost-effectively from plastic as a simple moulded body. Formed on the upper edge of the housing 9 is an outwardly projecting collar 21 which is supported against the opening 10 of the sanitary body 3. The housing 9 is inserted into the opening 10 from below and can be locked or otherwise fixed therein. In principle, the housing 9 could also be designed in such a way that it can be installed and removed from above.

What is claimed is:

1. A waste outlet fitting for a sanitary appliance comprising: a siphon which forms a stench trap and has an inlet, which is to be connected to a waste outlet opening of a sanitary body, and an outlet, which is to be connected to a soil pipe; wherein the siphon can be inserted into the waste outlet opening of the sanitary body from above and can be removed upwardly from the waste outlet opening wherein the siphon has an outlet which extends downwardly and which is mounted in a cup-shaped housing in an insertable manner.

2. The waste outlet fitting according to claim 1, wherein the siphon is mounted in a cup-shaped housing.

3. The waste outlet fitting according to claim 2, wherein the housing is supported against the waste outlet opening of the sanitary body.

4. The waste outlet fitting according to claim 3, wherein an upwardly directed inflow funnel is arranged at the inlet of the siphon.

5. The waste outlet fitting according to claim 3, wherein the siphon is mounted in the cup-shaped housing in an insertable manner.

6. The waste outlet fitting according to claim 2, wherein the siphon is mounted in the cup-shaped housing in an insertable manner.

7. The waste outlet fitting according to claim 2, wherein the housing is attached to the waste outlet opening of the sanitary body from below.

8. The waste outlet fitting according to claim 2, wherein the outlet of the siphon is of stopper-shaped design and can be inserted removably into a corresponding recess of the housing.

9. The waste outlet fitting according to claim 2, wherein an upwardly directed inflow funnel is arranged at the inlet of the siphon.

10. The waste outlet fitting according to claim 2, wherein a waste outlet bend is connected to the lower end of the siphon.

11. The waste outlet fitting according to claim 1, wherein an upwardly directed inflow funnel is arranged at the inlet of the siphon.

12. The waste outlet fitting according to claim 11, wherein the inflow funnel is sealed in relation to a cup-shaped housing, in which is mounted the siphon.

13. The waste outlet fitting according to claim 12, wherein the siphon is mounted in the cup-shaped housing in an insertable manner.

14. The waste outlet fitting according to claim 11, wherein the siphon is mounted in the cup-shaped housing in an insertable manner.

15. The waste outlet fining according to claim 1, wherein a waste outlet bend is connected to the lower end of the siphon.

16. The waste outlet fitting according to claim 15, wherein the waste outlet bend is designed in such a way that it forms a sump with water.

17. The waste outlet fitting according to claim 16, wherein the waste outlet bend is fastened to a bottom of a cup-shaped housing, in which is mounted the siphon.

18. The waste outlet fitting according to claim 1, wherein the waste outlet fitting can be installed and removed as a separate part.

19. The waste outlet fitting according to claim 1, wherein the siphon is a suction siphon.

20. The waste outlet fitting according to claim 1, wherein the sanitary appliance is a urinal.

* * * * *